US008136263B2

(12) United States Patent
Schmid

(10) Patent No.: US 8,136,263 B2
(45) Date of Patent: Mar. 20, 2012

(54) HAIR CARE APPLIANCE AND METHOD OF USING SAME

(75) Inventor: Heidi Schmid, Whitefish Bay, WI (US)

(73) Assignee: Heidi Schmid, Whitefish Bay, WI (US)

( * ) Notice: Subject to any disclaimer, the term of this patent is extended or adjusted under 35 U.S.C. 154(b) by 829 days.

(21) Appl. No.: 12/195,819

(22) Filed: Aug. 21, 2008

(65) Prior Publication Data

US 2010/0212179 A1 Aug. 26, 2010

Related U.S. Application Data

(60) Provisional application No. 60/935,611, filed on Aug. 21, 2007.

(51) Int. Cl.
*A45D 20/00* (2006.01)

(52) U.S. Cl. ..... 34/283; 34/97; 132/112; 392/384

(58) Field of Classification Search ..... 34/283, 34/97, 98, 99, 100, 101, 105; 132/112; 392/380, 392/384; 219/367, 373; 239/602, 567
See application file for complete search history.

(56) References Cited

U.S. PATENT DOCUMENTS

| | | | | | |
|---|---|---|---|---|---|
| 3,610,258 | A | * | 10/1971 | Van Droogenbroeck | 132/269 |
| 3,612,069 | A | * | 10/1971 | Waters et al. | 132/212 |
| 3,665,939 | A | * | 5/1972 | Laing | 132/233 |
| 3,692,032 | A | * | 9/1972 | Regas | 132/212 |
| 3,745,306 | A | * | 7/1973 | Naritomi | 392/335 |
| 3,746,015 | A | * | 7/1973 | Schulman | 132/212 |
| 3,760,148 | A | * | 9/1973 | Boudouris et al. | 219/222 |
| 3,762,424 | A | * | 10/1973 | Chen | 132/226 |
| 3,814,111 | A | * | 6/1974 | Doyle et al. | 132/272 |
| 3,889,693 | A | * | 6/1975 | Tanaka et al. | 132/272 |
| 3,905,379 | A | * | 9/1975 | Churas et al. | 132/272 |
| 3,908,673 | A | * | 9/1975 | Carr | 132/223 |
| 3,947,659 | A | * | 3/1976 | Ono | 392/404 |
| 3,955,064 | A | * | 5/1976 | Demetrio et al. | 219/225 |
| 4,041,961 | A | * | 8/1977 | Shaler et al. | 132/245 |
| 4,097,718 | A | * | 6/1978 | Weise | 219/222 |

(Continued)

FOREIGN PATENT DOCUMENTS

DE 4235436 A1 * 4/1993

(Continued)

OTHER PUBLICATIONS

Instruction Booklet—Handheld Fabric Steamer [GS15RN], Conair, 4 pages, Available online at: <http://www.conair.com/instruction_booklets/06PC2284%20gs15rn%20final.pdf>, 2006.

(Continued)

*Primary Examiner* — Stephen M. Gravini
(74) *Attorney, Agent, or Firm* — Michael Best & Friedrich LLP

(57) ABSTRACT

A hair care appliance for application of vapor to dry hair including a housing having a head portion and a handle portion, the housing defining an inner cavity. A vapor-generating system is positioned at least partially within the cavity, and the head portion includes an aperture in communication with the vapor-generating system. A spacer is positioned proximate the aperture of the head portion and partially defines a work area for positioned hair, wherein the vapor-generating system discharges vapor to the work area for application to hair positioned thereby.

32 Claims, 10 Drawing Sheets

U.S. PATENT DOCUMENTS

| | | | | | |
|---|---|---|---|---|---|
| 4,114,022 | A | | 9/1978 | Braulke, III | |
| 4,134,412 | A | * | 1/1979 | Gross et al. | 132/203 |
| 4,135,524 | A | * | 1/1979 | Rosenberg et al. | 132/203 |
| 4,164,951 | A | * | 8/1979 | Shaler et al. | 132/233 |
| 4,166,473 | A | * | 9/1979 | Bauer et al. | 132/272 |
| 4,195,416 | A | * | 4/1980 | Hall | 34/90 |
| 4,217,914 | A | * | 8/1980 | Jacquet et al. | 132/208 |
| 4,220,846 | A | * | 9/1980 | Rice et al. | 392/488 |
| 4,230,279 | A | * | 10/1980 | Forsberg | 239/559 |
| 4,232,454 | A | * | 11/1980 | Springer | 34/97 |
| 4,243,061 | A | * | 1/1981 | Buchanan | 132/118 |
| 4,256,127 | A | * | 3/1981 | Tsujimoto et al. | 132/212 |
| 4,260,875 | A | * | 4/1981 | Walter et al. | 392/385 |
| 4,263,500 | A | * | 4/1981 | Springer et al. | 392/410 |
| 4,266,116 | A | | 5/1981 | Bauer et al. | |
| 4,279,262 | A | * | 7/1981 | Horin et al. | 132/202 |
| 4,287,673 | A | * | 9/1981 | Wolter | 34/97 |
| 4,295,283 | A | * | 10/1981 | Tomaro | 34/97 |
| 4,296,763 | A | * | 10/1981 | Priest et al. | 132/200 |
| 4,298,014 | A | * | 11/1981 | MacLennan | 132/270 |
| 4,310,747 | A | * | 1/1982 | Rice et al. | 392/466 |
| 4,327,278 | A | * | 4/1982 | Tomaro | 392/379 |
| 4,341,229 | A | * | 7/1982 | Bauer et al. | 132/211 |
| 4,391,047 | A | * | 7/1983 | Janssens et al. | 34/97 |
| 4,409,998 | A | * | 10/1983 | Bauer | 132/227 |
| 4,481,961 | A | * | 11/1984 | Bauer et al. | 132/203 |
| 4,503,317 | A | * | 3/1985 | Mancillas | 219/225 |
| 4,590,687 | A | * | 5/1986 | Caruso | 34/97 |
| 4,601,299 | A | * | 7/1986 | Wolfram et al. | 132/207 |
| 4,605,019 | A | * | 8/1986 | Reynolds et al. | 132/272 |
| 4,610,261 | A | * | 9/1986 | Madrange et al. | 132/206 |
| 4,632,133 | A | * | 12/1986 | Losenno | 132/231 |
| 4,757,183 | A | * | 7/1988 | Karey et al. | 392/341 |
| 4,759,135 | A | * | 7/1988 | Scivoletto | 34/97 |
| 4,848,007 | A | * | 7/1989 | Montagnino | 34/97 |
| 4,875,792 | A | * | 10/1989 | Canada | 401/283 |
| 4,911,185 | A | * | 3/1990 | Losenno | 132/211 |
| 4,931,271 | A | * | 6/1990 | Lang et al. | 424/47 |
| 4,936,027 | A | | 6/1990 | Tsuji | |
| 5,002,075 | A | * | 3/1991 | Kellett et al. | 132/108 |
| 5,010,905 | A | * | 4/1991 | Snyder et al. | 132/272 |
| 5,036,601 | A | * | 8/1991 | Mulle et al. | 34/97 |
| 5,060,398 | A | * | 10/1991 | Wolens | 34/90 |
| 5,170,808 | A | * | 12/1992 | Vild | 132/210 |
| 5,235,759 | A | * | 8/1993 | Rizzuto, Jr. | 34/97 |
| 5,241,974 | A | * | 9/1993 | Tsai | 132/272 |
| 5,246,019 | A | * | 9/1993 | Godfrey et al. | 132/208 |
| 5,261,426 | A | * | 11/1993 | Kellett et al. | 132/108 |
| 5,261,427 | A | | 11/1993 | Dolev | |
| 5,263,501 | A | * | 11/1993 | Maznik | 132/211 |
| 5,275,339 | A | * | 1/1994 | Andis et al. | 239/443 |
| 5,286,949 | A | * | 2/1994 | Simons | 219/222 |
| 5,327,919 | A | * | 7/1994 | Hanlon | 132/270 |
| 5,365,953 | A | * | 11/1994 | Feughelman | 132/231 |
| 5,400,809 | A | * | 3/1995 | Adams | 132/118 |
| 5,497,796 | A | * | 3/1996 | Mochizuki et al. | 132/201 |
| 5,520,199 | A | * | 5/1996 | Sturla | 132/206 |
| 5,520,200 | A | * | 5/1996 | Sturla | 132/206 |
| 5,551,453 | A | * | 9/1996 | Sturla | 132/206 |
| 5,566,689 | A | * | 10/1996 | Yeater | 132/212 |
| 5,572,800 | A | * | 11/1996 | West | 34/97 |
| 5,573,016 | A | * | 11/1996 | Graves | 132/254 |
| 5,575,989 | A | * | 11/1996 | Caskey | 424/62 |
| 5,584,307 | A | * | 12/1996 | Bauer et al. | 132/113 |
| 5,584,308 | A | * | 12/1996 | Maekawa | 132/203 |
| 5,601,099 | A | * | 2/1997 | Mochizuki et al. | 132/201 |
| 5,639,448 | A | * | 6/1997 | Galleguillos et al. | 424/70.11 |
| 5,649,370 | A | | 7/1997 | Russo | |
| 5,761,824 | A | | 6/1998 | Moon et al. | |
| 5,781,691 | A | | 7/1998 | Kwok | |
| 5,857,262 | A | * | 1/1999 | Bonnema et al. | 34/97 |
| 5,857,470 | A | * | 1/1999 | Schmidt et al. | 132/211 |
| 5,913,315 | A | * | 6/1999 | Todd | 132/208 |
| 6,007,793 | A | * | 12/1999 | Bhatt et al. | 424/47 |
| 6,022,380 | A | * | 2/2000 | Satoh | 8/405 |
| 6,035,099 | A | * | 3/2000 | Stern | 392/405 |
| 6,053,178 | A | * | 4/2000 | Todd | 132/208 |
| 6,119,702 | A | | 9/2000 | Habibi | |
| 6,199,558 | B1 | * | 3/2001 | Schmidt et al. | 132/211 |
| 6,325,072 | B1 | | 12/2001 | Smetana | |
| 6,350,434 | B1 | * | 2/2002 | Bhatt et al. | 424/47 |
| 6,802,320 | B2 | | 10/2004 | Janouch et al. | |
| 6,973,931 | B1 | * | 12/2005 | King | 132/212 |
| 6,986,217 | B2 | | 1/2006 | Leung et al. | |
| 7,028,348 | B2 | * | 4/2006 | Tadaka et al. | 4/516 |
| 7,155,117 | B2 | | 12/2006 | Leung et al. | |
| D547,067 | S | | 7/2007 | Choi | |
| 7,562,661 | B2 | * | 7/2009 | Ueyama et al. | 132/206 |
| 7,772,526 | B2 | * | 8/2010 | Chuong | 219/385 |
| 7,946,056 | B2 | * | 5/2011 | Kroll et al. | 34/96 |
| 2002/0157682 | A1 | * | 10/2002 | Ueyama et al. | 132/221 |
| 2002/0176704 | A1 | * | 11/2002 | Roe | 392/393 |
| 2003/0150126 | A1 | * | 8/2003 | Chang et al. | 34/96 |
| 2005/0284493 | A1 | * | 12/2005 | Allen | 132/225 |
| 2006/0018638 | A1 | | 1/2006 | Leung | |
| 2006/0191554 | A1 | * | 8/2006 | Lafuente | 132/224 |
| 2007/0193599 | A1 | * | 8/2007 | Sakakibara | 132/211 |
| 2007/0209672 | A1 | * | 9/2007 | Pruess | 132/200 |
| 2007/0212309 | A1 | * | 9/2007 | Pruess | 424/47 |
| 2007/0267037 | A1 | * | 11/2007 | Hur | 132/232 |
| 2008/0092915 | A1 | * | 4/2008 | Chan | 132/232 |
| 2008/0210253 | A1 | * | 9/2008 | Carballada et al. | 132/206 |
| 2009/0083986 | A1 | * | 4/2009 | Langley et al. | 34/98 |
| 2009/0159093 | A1 | * | 6/2009 | Yu | 132/211 |
| 2009/0165811 | A1 | * | 7/2009 | Zimmerman | 132/203 |
| 2009/0260650 | A1 | * | 10/2009 | Jung | 132/224 |
| 2009/0283106 | A1 | * | 11/2009 | Torgerson et al. | 132/202 |
| 2010/0206322 | A1 | * | 8/2010 | Mukai | 132/269 |
| 2010/0224206 | A1 | * | 9/2010 | Serresvives et al. | 132/212 |
| 2010/0242986 | A1 | * | 9/2010 | Serresvives et al. | 132/227 |
| 2010/0288298 | A1 | * | 11/2010 | Serresvives et al. | 132/272 |
| 2010/0307528 | A1 | * | 12/2010 | Restle et al. | 132/211 |
| 2011/0005538 | A1 | * | 1/2011 | Mercier et al. | 132/112 |
| 2011/0048446 | A1 | * | 3/2011 | Torgerson et al. | 132/202 |
| 2011/0067720 | A1 | * | 3/2011 | Ranade et al. | 132/202 |
| 2011/0067721 | A1 | * | 3/2011 | Tate et al. | 132/203 |

FOREIGN PATENT DOCUMENTS

| | | | | |
|---|---|---|---|---|
| DE | 10224066 | A1 | * | 12/2003 |
| DE | 10232016 | A1 | * | 2/2004 |
| FR | 2720147 | A1 | * | 11/1995 |
| FR | 2778823 | A1 | * | 11/1999 |
| JP | 53119156 | | | 10/1978 |
| JP | 01038259 | A | * | 2/1989 |
| JP | 2005177234 | A | * | 7/2005 |
| JP | 2006263536 | A | * | 10/2006 |

OTHER PUBLICATIONS

Hand Held Steamer Search, NexTag Comparison Shopping, 2 pages, Available online at: <http://www.nextag.com/hand-held-steamer/search-html>, Printed Jul. 8, 2008.

Steam Buddy, AmeriMark, 1 page, Available online at: <http://www.amerimark.com/cgi-bin/amerimark/postkey__find.html?cm__re=celebros-__-center-__-search%20promo&keywords=026873>, Printed Jul. 8, 2008.

Hand Held Clothes Steamer Brand New in Box Avon Exclsiv, ebay, Item 350071390352, 2 pages, Available online at: <http://cgi.ebay.com/HAND-HELD-CLOTHES-STEAMER-BRAND-NEW-IN-BOX-AVON-EXCLSIV__W0QQitemZ350071390...>, Printed Jul. 8, 2008.

Smartek Steam-X Powerful Steam Brush, Createforless, 1 page, Available online at: <http://www.createforless.com/Smartek+Steam-X+Powerful+Steam+Brush/pid113347.aspx?utm__source=goolebase&utm__mediu...>, Printed Jul. 8, 2008.

Rowenta Ultra Compact Steam Brush, Williams-Sonoma, 1 page, Available online at: <http://www.williams-sonoma.com/products/sku5189311/index.cfm?pkey=xsrd0m1%7C16%7C%7C%7C0%7C%7C%7C%7C%7C%7C%7Crowenta%20ultra%20compact%20steam%20brush&cm%5Fsrc=SCH>, Printed Jul. 8, 2008.

European Patent Office Extended Search Report for Application No. 10250870.2, dated Jan. 13, 2011 (7 pages).

* cited by examiner

HAIR CARE APPLIANCE AND METHOD OF USING SAME

CROSS-REFERENCE TO RELATED APPLICATIONS

The present patent application claims priority to U.S. Provisional Patent Application Ser. No. 60/935,611, filed on Aug. 21, 2007, the entire contents of which are hereby incorporated by reference.

BACKGROUND

The present invention relates to hand-held hair care appliances, and in particular, a hair care appliance that produces vapor.

For persons with curly or wavy hair, curls may diminish during the day or overnight. Further, the hair may become frizzy or flat due to various environmental factors, such as heat, humidity, wind, etc. Hair, whether straight or curly, is also likely to be affected by static electricity, have less volume, and/or retain an undesired shape, such as from the constriction of a hair tie, clip, or hat. To enhance or reactivate the curl or reshape hair, a person normally wets or washes their hair and then restyles the hair, which can be time-consuming and burdensome.

Heat is commonly used for hair styling purposes including drying hair, setting curls in otherwise straighter hair, straightening otherwise curlier hair, or increasing hair volume. The dry heat produced by many hair care appliances for styling purposes can damage the hair shafts over time by stripping them of moisture; therefore, heat-generating hair appliances do not enhance curly or wavy hair without damaging the hair.

SUMMARY

In one embodiment, the invention provides a hair care appliance for application of vapor to dry hair including a housing having a head portion and a handle portion, the housing defining an inner cavity. A vapor-generating system is positioned at least partially within the cavity, and the head portion includes an aperture in communication with the vapor-generating system. A spacer is positioned proximate the aperture of the head portion and partially defines a work area for positioned hair, wherein the vapor-generating system discharges vapor to the work area for application to hair positioned thereby.

In another embodiment, the invention provides a method of providing humidity to dry hair including providing a hand-held vapor generating device including a spacer, the spacer at least partially defining a work area. The device is positioned relative to a user's head such that hair is gathered within the work area and vapor is discharged from the device into the work area to contact the hair gathered therein.

In still another embodiment, the invention provides a hair care appliance for application of vapor to dry hair to provide humidity. The hair care appliance includes a housing defining an inner cavity and an aperture. A spacer is coupled to the housing and at least partially defines a work area in which a user's hair is gathered. A vapor-generating system is at least partially disposed within the cavity, wherein the aperture provides a fluid pathway for discharging vapor from the vapor-generating system into the work area.

Other aspects of the invention will become apparent by consideration of the detailed description and accompanying drawings.

Figure 1:
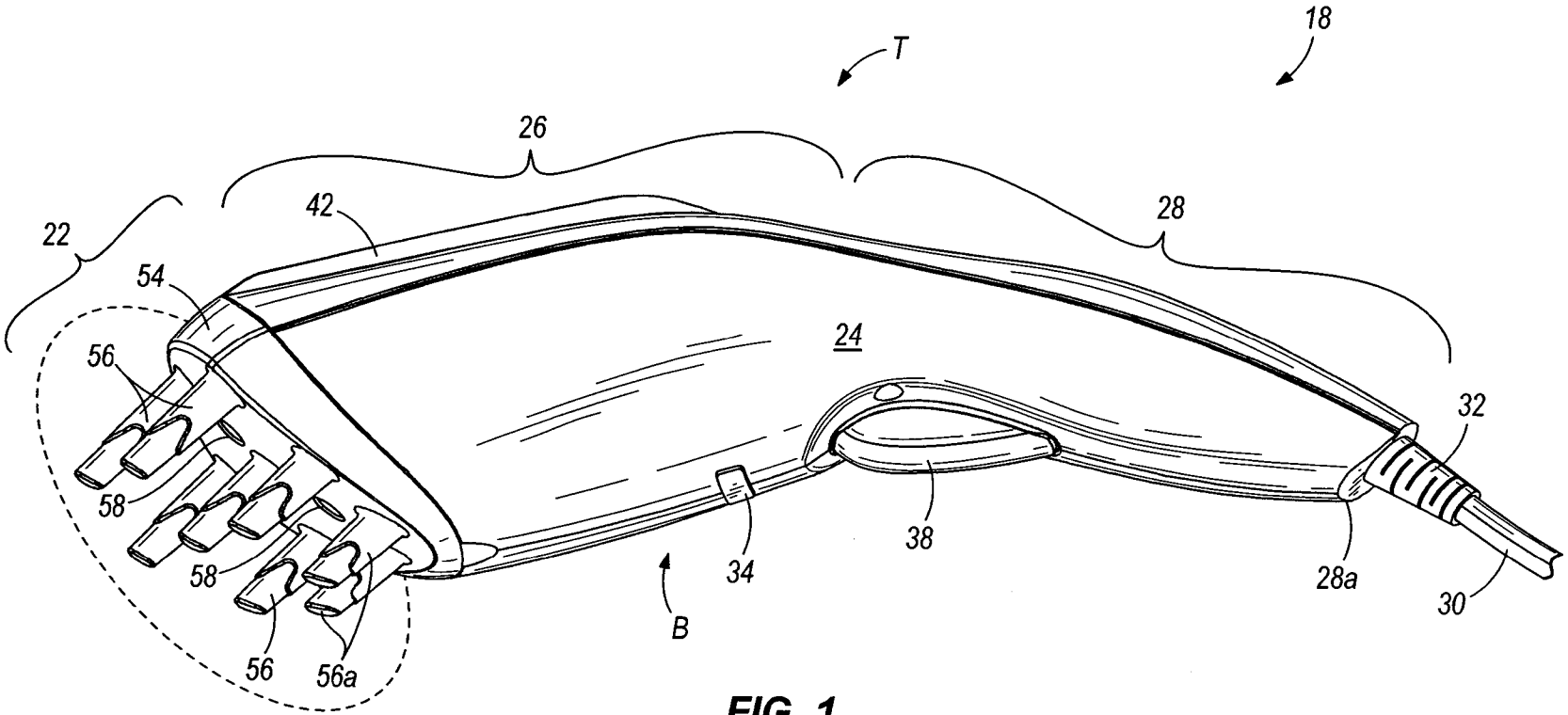
FIG. 1 is a side perspective view of a hair care appliance according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

This invention provides a hand-held appliance for applying vapor to hair in order to provide moisture or humidity to hair to enhance curls or waves, increase hair volume, decrease static within the hair, and/or reshape hair. The appliance may be used with dry or substantially dry hair, which is hair free from moisture; or dry (or substantially dry) and damaged hair, that is, hair characterized by an absence, deficiency or failure of natural or ordinary moisture (e.g., hair with static). In the description and claims which follow, the term "dry" will be used to refer to any of the above conditions, including any combination of these conditions.

FIGS. 1-4 show a hair care appliance 18 according to one embodiment of the invention. The hair care appliance 18 is particularly suitable for use enhancing and reactivating curls in curly and wavy hair and for styling curls, as well as reshaping hair by providing moisture to the hair. In the illustrated embodiment of FIGS. 1-4, the hair care appliance 18 is a hand-held device including a vapor-generating system 20 (FIG. 7) and an integrated spacer 22. It is to be understood by one of ordinary skill in the art that in a further embodiment, the spacer 22 may be an interchangeable attachment that is removably coupled to the hand-held device.

Referring to FIGS. 1-4, the hair care appliance 18 includes a housing 24 that defines a head portion 26 and a handle portion 28. In the illustrated embodiment, the housing 24 is elongated and contoured for ease of gripping by a user; however, in further embodiments the housing 24 may have other shapes. A power cord 30 extends from the handle portion 28 of the housing 24. A cord guard 32 is positioned around the power cord 30 at the location where the power cord 30 enters the housing 24. The cord guard 32 acts as a joint, allowing the power cord 30 to be flexed during use of the hair care appliance 18 without sustaining damage. In a further embodiment in which the appliance 18 is battery powered, neither a power cord 30 nor a cord guard 32 is necessary.

Figure 2:
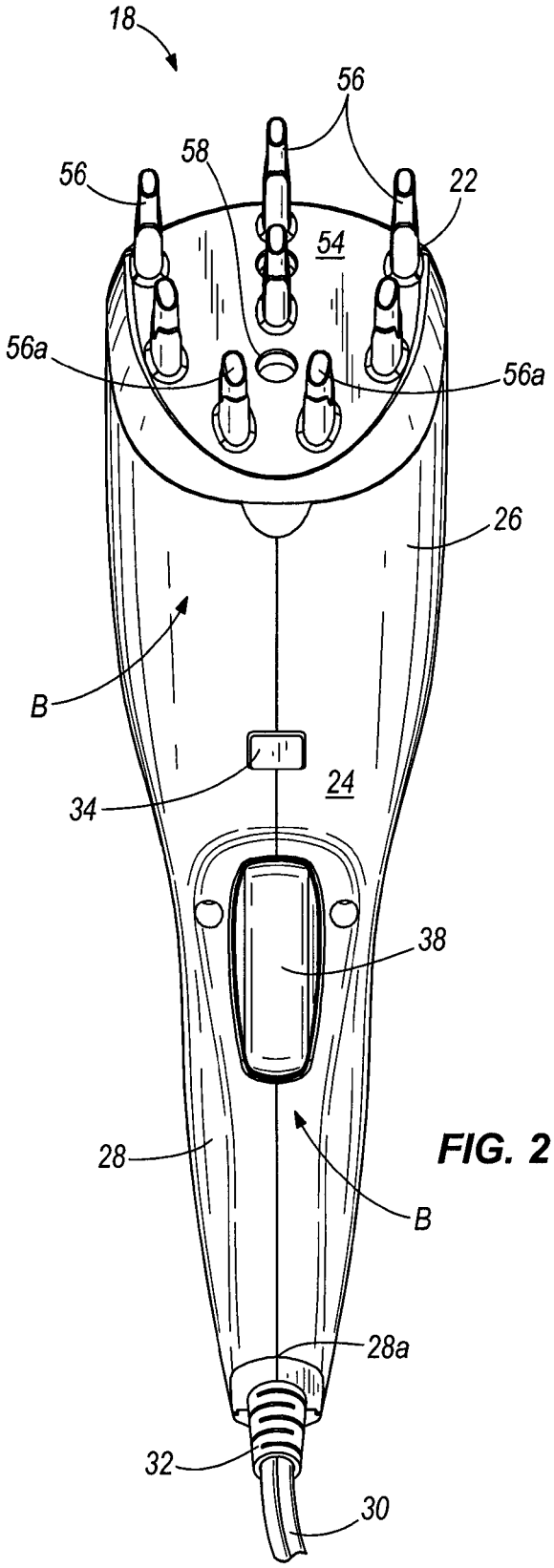
FIG. 2 is a bottom view of the hair care appliance shown in FIG. 1.

As shown in FIGS. 1 and 2 of the illustrated embodiment, a power switch 34 (e.g., a push button, toggle, etc.) is included on the housing 24 for turning the hair care appliance 18 on and off. The power switch 34 is located on a bottom side B of the housing 24 between the head portion 26 and the handle portion 28. The bottom side B of the appliance 18 is shown in FIG. 2. In a further embodiment, the power switch 34 may have multiple settings to adjust the vapor output of the hair care appliance 18. In a still further embodiment, a setting regulator that is separate and distinct from the power switch 34 may be included on the appliance 18. An indicator light 36 is positioned on a top side T of the housing 24 between the head portion 26 and the handle portion 28. The top side T of the appliance 18 is shown on the left side of FIG. 3. In another embodiment the power switch 34 and/or the indicator light 36 may be located at different positions on the housing 24 (e.g., the end of the handle portion 28 proximal to the cord guard 32). An actuator 38 (e.g., a button, trigger, etc.), for releasing vapor from the appliance 18, is located between the head portion 26 and the handle portion 28 on the bottom side B of the housing 24 in a position accessible to a user's fingers when gripping the handle portion 28. In another embodiment the actuator 38 may be located in any position on the housing 24 that is accessible to the user's gripping hand. In a further embodiment, the actuator 38 may incorporate the power switch 34 and/or setting regulator.

Figure 3:
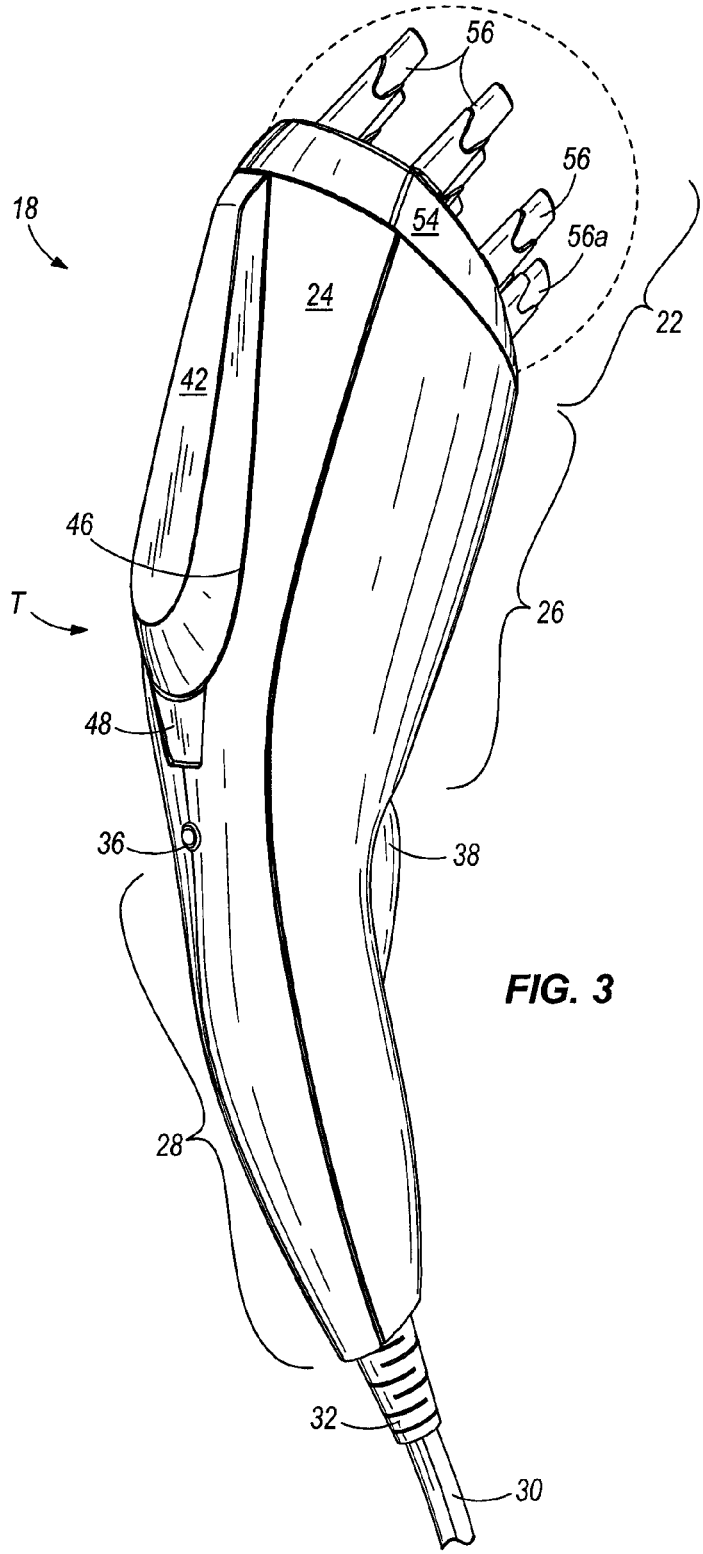
FIG. 3 is a top perspective view of the hair care appliance shown in FIG. 1.
Figure 4:
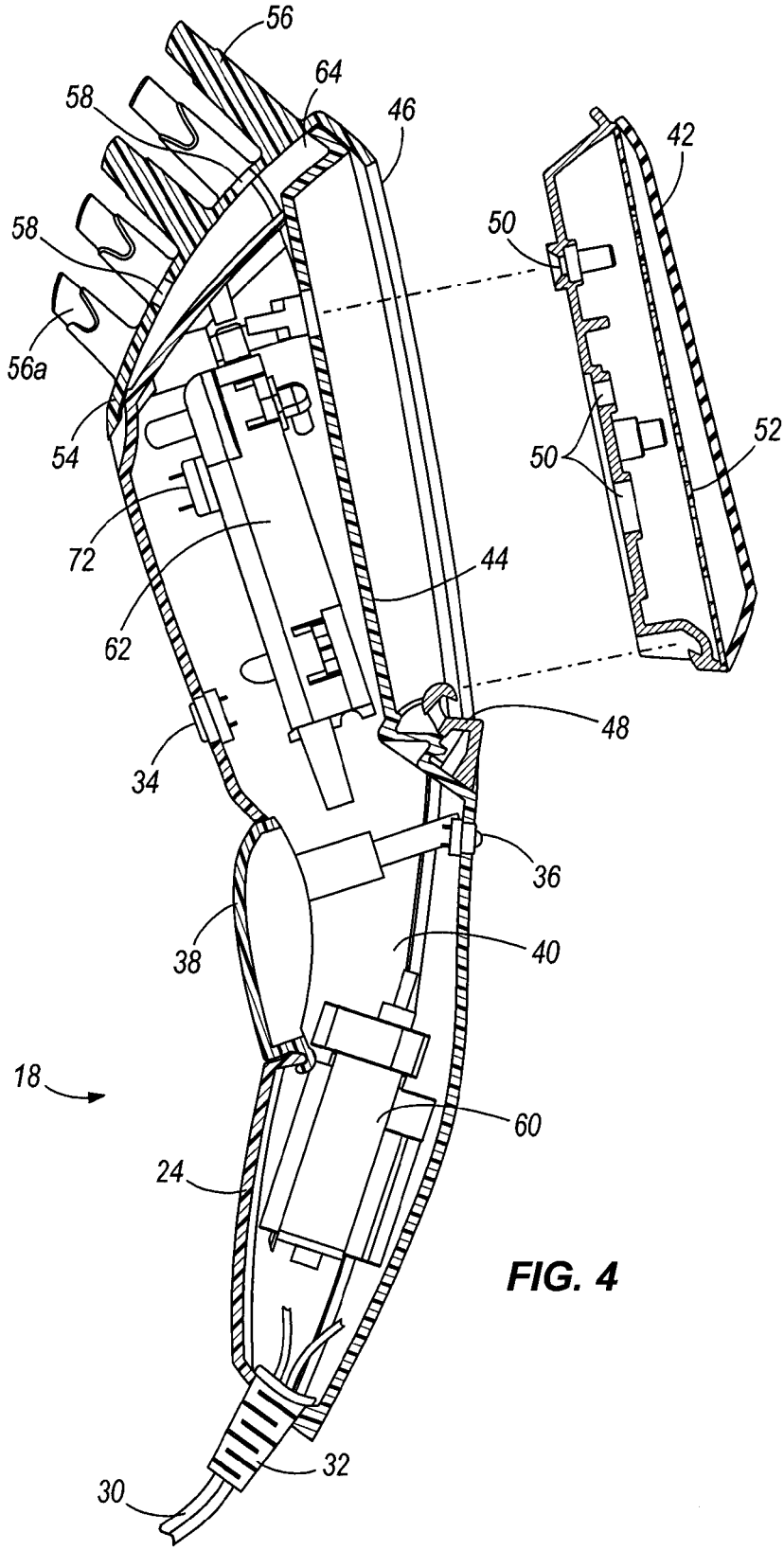
FIG. 4 is a cut away and partially exploded view of the hair care appliance shown in FIG. 1.

The housing 24 defines an inner cavity 40 that contains the vapor-generating system 20. A reservoir 42 is positioned within the inner cavity 40 of the hair care appliance 18 and is separated from the other components by a partition 44. As shown in FIGS. 3 and 4, the housing 24 includes an opening 46 communicating with the inner cavity 40 to facilitate removal of the reservoir 42 from the inner cavity 40 of the appliance 18. A reservoir release 48 allows a user to release the reservoir 42 from engagement with the housing 24 so that a liquid may be added to the reservoir 42. In a further embodiment, the reservoir 42 may be an integral component of the housing 24 and a reservoir cover may be removably or moveably coupled to the housing 24 to cover the opening 46. In such an embodiment, the reservoir release 48 allows a user to release the reservoir cover from secured engagement with the housing 24 so that a liquid may be added to the reservoir 42.

Referring to FIG. 4, the reservoir 42 includes apertures 50 that function as inlets and outlets for liquid into and out of the reservoir 42. In a further embodiment, the reservoir 42 may alternatively or in addition contain at least one dedicated inlet aperture 50 for filling the reservoir 42, and/or at least one dedicated outlet aperture 50 for movement of the liquid from the reservoir 42 into the vapor-generating system 20. The reservoir 42 may include a plug that is removed from aperture 50 in order to fill the reservoir 42 and is replaced before returning the reservoir 42 to the inner cavity 40. In a further embodiment, at least one of the apertures 50 can be fitted with a valve to control the flow of liquid into and out of the reservoir 42. The reservoir 42 contains a liquid such as water, but can also contain other vaporizable liquids or water with additives (e.g., scent, conditioning substances, etc.). In a further embodiment, additives may be introduced to the system at a position downstream of where the liquid becomes vapor, for example, in a manifold 64 or the spacer 22.

In the illustrated embodiment, the reservoir 42 is formed of a transparent polymer enabling the user to visually monitor the amount of liquid in the reservoir 42 without removing the reservoir 42 from the housing 24. The reservoir 42, shown in cross-section in FIG. 4, is comprised of two dish-shaped pieces of polymer. A plate 52, having a perimeter the desired shape of the opening of each of the dish-shaped pieces, is used to guide formation of at least one of the dish-shaped pieces. Alternatively, or in addition, the plate 52 is used to align the edge of one dish-shaped piece with the edge of the other dish-shaped piece. The two pieces are then fused or glued together to form the reservoir 42. Because the plate 52 remains within the transparent reservoir 42 after it is formed, it is provided with cutouts, and in some embodiments, etchings to add a decorative element to the appliance 18 to allow liquid to completely fill and move within the reservoir 42.

The spacer 22 extends from the head portion 26 of the housing 24 of the hair care appliance 18. The spacer 22 includes a cap 54 and spacer elements 56 projecting outwardly from the cap 54 where the spacer elements 56 at least partially define a work area for the appliance 18 (indicated by a dashed-line perimeter in FIGS. 1 and 3). The work area is a three-dimensional space to which vapor is first expelled from the hair care appliance 18 and where treatment of a user's hair takes place. In the illustrated embodiment, the cap 54 is sized and shaped to complement the head portion 26 of the housing 24; however, in a further embodiment the cap 54 may be sized smaller or larger than the head portion 26 or have other shapes. The spacer 22 is removably coupled to the head portion 26 of the housing 24 and interchangeable with spacers 22 having different shapes or sizes. Alternatively, the spacer 22 may be integrated with the head portion 26 of the housing 24. The spacer cap 54 contains apertures 58 that allow vapor to pass from the vapor-generating system 20 through the cap 54 to a user's hair gathered in the work area.

In the illustrated embodiment, eight, finger-like spacer elements 56 project outwardly from the cap 54 and away from the housing 24. The spacer elements 56 keep the spacer apertures 58 a safe distance from the head of the user so that vapor exiting the vapor-generating system 20 is cooled sufficiently by the time it reaches a user's scalp. The spacer elements 56 also lift and separate the hair to improve circulation of the vapor to the hair within the work area. Further, two spacer elements **56*a* also function as two points of a tripod formation that provides the hair care appliance 18 with a stable rest position on a level surface such as a dressing table or counter top. The third point of the tripod formation is provided by the end 28*a* of the handle portion 28 of the appliance 18**.

Figure 6:
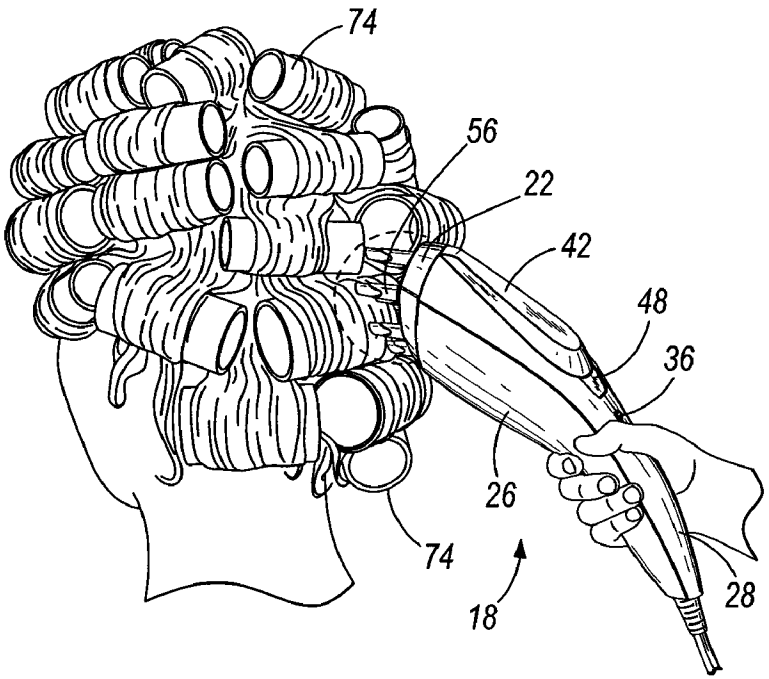
FIG. 6 is an illustration of another use of the hair care appliance shown in FIG. 1.
Figure 7:
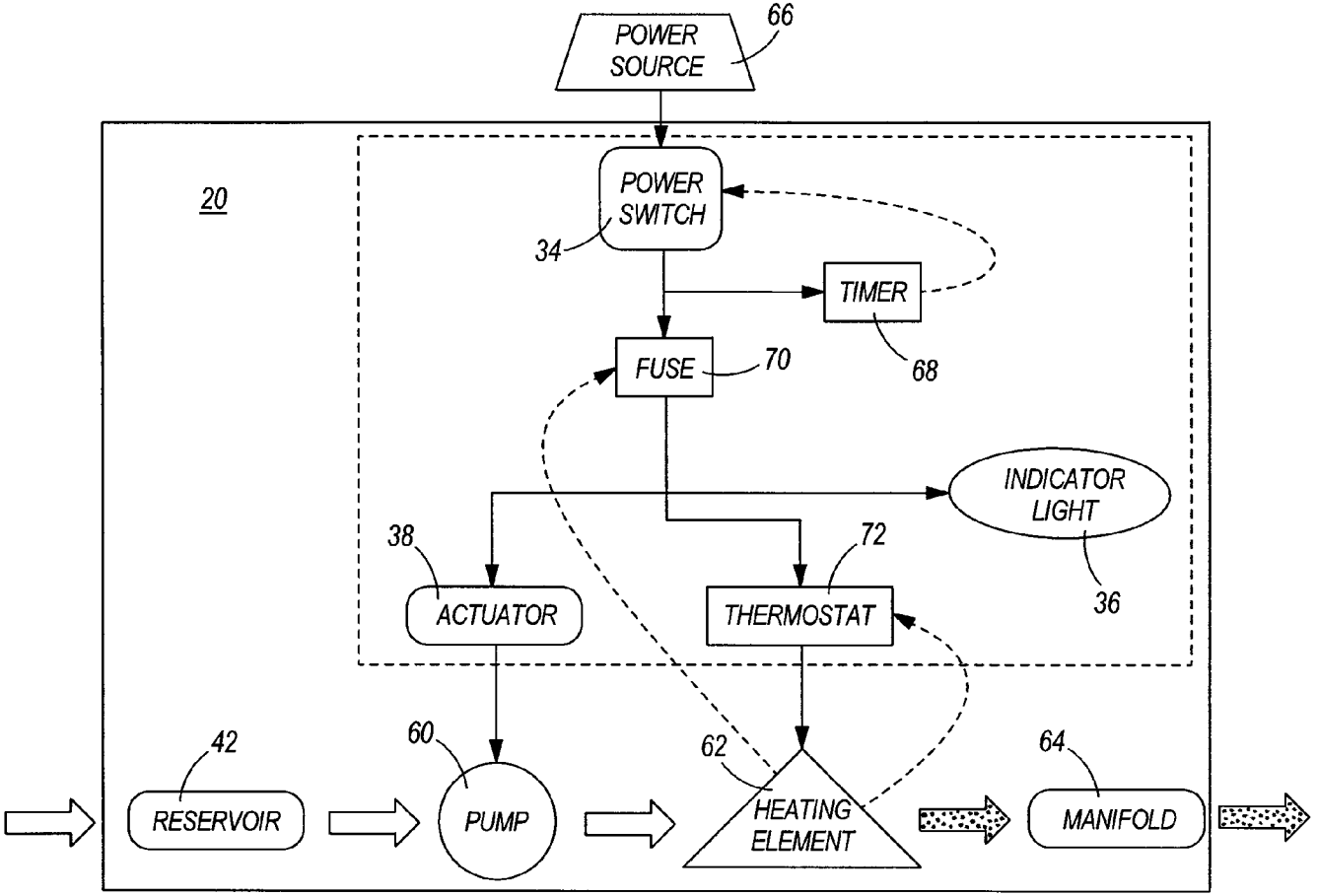
FIG. 7 is a schematic of the vapor-generating system of the hair care appliance shown in FIG. 1.

FIG. 7 illustrates one embodiment of the vapor-generating system 20 located within the inner cavity 40 of the hair care appliance 18. In the illustrated embodiment, the vapor-generating system 20 includes the reservoir 42, a pump 60, a heating element 62, and a manifold 64. These components are connected in series as indicated in FIG. 7 by tubing or piping (not shown) to form a fluid path for the liquid (indicated by unfilled arrows) and vapor (indicated by filled arrows) as it travels between the components of the vapor-generating system 20. It is contemplated that various components may be provided alternatively or in addition to those described below, or that the vapor-generating system 20 may be configured without certain components or in various alternative schematic arrangements. With this in mind, the following description of the embodiment shown in FIGS. 1-7 is presented by way of example only.

The reservoir 42 stores a liquid for vaporization and is accessible for filling via the opening 46 and reservoir release 48 in the housing 24 as described above. In the illustrated embodiment, the liquid is water for generating steam, although it should be readily apparent to those of skill in the art that other liquids (e.g., water with an additive) for vaporization can be used. The pump 60 moves or transfers liquid from the reservoir 42 to the heating element 62 when the user depresses the actuator 38. The pump 60 is a centrifugal dry-run pump that will also pump air (e.g., should the reservoir 42 be emptied of liquid, leaving only air for the pump to move). In a further embodiment, user input via a multi-setting regulator may increase or decrease the rate at which liquid is pumped, thereby creating and causing the appliance 18 to expel more or less vapor.

The heating element 62 in the illustrated embodiment is a CalRod, which converts the liquid supplied by the pump 60 to a vapor, such as steam. In a further embodiment, the heating element can be any suitable type known in the art. The vapor travels from the heating element 62 via the manifold 64 out of the appliance 18 through the apertures 58 in the spacer cap 54. The manifold 64 is an isolated space or conduit enclosed by the spacer cap 54 and the head portion 26 of the housing 24, as illustrated in FIG. 4, and is positioned along the fluid flow path between a vapor outlet of the heating element 62 and the spacer apertures 58. The manifold 64 provides an area for vapor to cool before it enters the work area in order to prevent the user from sustaining injury from the hot vapor. Because vapor is cooled in the manifold 64, some condensation is likely to occur within the conduit. In a further embodiment, the manifold 64 may be formed within the inner cavity 40.

In a further embodiment, the manifold 64 may be provided with a sponge-like material or chemical desiccant (neither shown) to absorb any condensed liquid, thereby preventing the hair care appliance 18 from dripping or leaking during or after use. In a still further embodiment, the sponge-like material or desiccant may have anti-microbial, anti-fungal, and/or aromatic properties (or contain a substance with at least one of these properties). Further, a hair conditioning or treatment additive may be contained in the manifold (e.g., in the sponge) to be dissolved, delivered, and applied to a user's hair by means of the vapor.

Referring to FIGS. 4 and 7, the inner cavity 40 of the hair care appliance 18 also contains several electrical components (enclosed by a dashed-line rectangle in FIG. 7) that power and control the vapor-generating system 20. Flow-paths of electricity through/to the components (i.e., the schematic circuitry) of the hair care appliance 18 are indicated by solid line arrows. The power cord 30 provides an electrical connection between the vapor-generating system 20 and a power source 66 (i.e., a wall outlet providing an alternating current (AC) power). In a further embodiment, the power source 66 may be in the form of direct current (DC) power provided by a battery (e.g., a rechargeable battery disposed in the cavity). In another embodiment, the appliance 18 may include a voltage selection switch enabling its use with either a 110V or a 220V power supply.

In the illustrated embodiment, the power switch 34 is set to either an "on" or "off" position by the user. When the power switch 34 is set to an "on" position, electricity is allowed to flow from the power source 66 through a fuse 70, and then in parallel to the indicator light 36, the actuator 38, and a thermostat 72. The actuator 38 provides a user interface with the pump 60 such that when the actuator 38 is depressed (or otherwise triggered), electricity flows to the pump 60, causing the pump 60 to move fluid through the vapor-generating system 20. The electricity that flows to the thermostat 72 continues on to heating element 62, causing it to produce heat. Similarly, the electricity that flows to the indicator light 36 causes it to emit light. Consequently, when electricity is flowing through the power cord 30, power switch 34 ("on"), fuse 70, thermostat 72, and heating element 62, the indicator light 36 is "on".

The power switch 34 is controlled by a timer 68, such that after the power switch 34 has been in the "on" position for a set amount of time, the timer 68 opens the circuit at the power switch 34, thereby stopping the flow of electricity through the circuit. Consequently, if a user forgets to turn off the hair care appliance 18 after use or leaves it unattended, after a period of time, electricity to the power consuming/dissipating elements will be cut off (i.e., the heating element 62 will cool, etc.), thereby providing the invention with both safety and energy-saving features. This feedback path providing an automatic shut-off feature and others (described below) are indicated by dashed-line arrows in FIG. 7.

The thermostat 72 provides the hair care appliance 18 with another safety feature. Thermostat 72 senses the amount of heat produced by the heating element 62 and adjusts the heat to a set temperature point by regulating the amount of electricity that the heating element 62 receives and dissipates as heat. Consequently, the temperature of the vapor output by the heating element 62 is kept within a range that is useful for styling/reconditioning hair, yet does not pose a risk of injury to the user. Further, the thermostat 72 prevents the heating element 62 from causing damage to the other components of the hair care appliance 18.

The fuse 70 provides a backup safety measure for use of the hair care appliance 18. The fuse 70 is a thermal electric fuse, which in response to either an excessive amount of electricity flow or heat flow, opens the circuit at the fuse 70, thereby stopping the flow of electricity through the circuit. Consequently, if the thermostat 72 malfunctions or there is a power surge from the power source 66, electricity to the power consuming/dissipating elements beyond the power switch 34 will be cut off (i.e., the heating element 62 will cool, etc.), preventing damage to other components of the hair care appliance 18.

Figure 5:
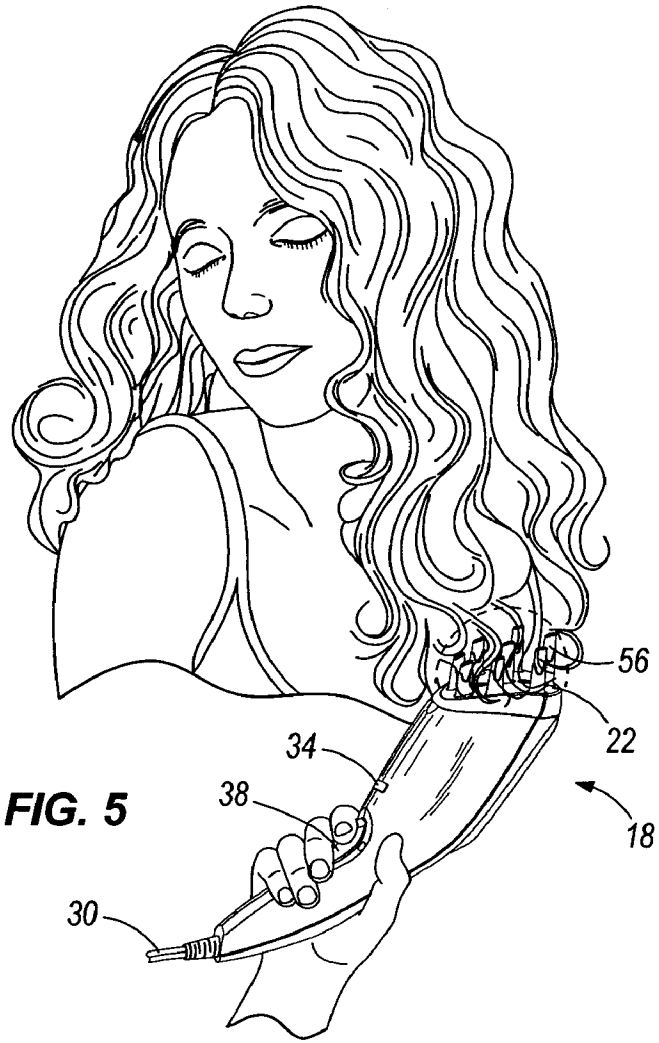
FIG. 5 is an illustration of one use of the hair care appliance shown in FIG. 1.

Referring to FIGS. 5 and 6, the hair care appliance 18 operates to quickly and easily enhance, reactivate, or set curls or waves, in particular, while hair remains substantially dry. The appliance 18 also operates to reshape hair and increase volume or moisture (i.e., humidity) in dry or dry and damaged hair. Prior to use, the reservoir 42 is filled with a liquid. The power cord 30 of the appliance 18 is connected to a power source 66. Once the heating element 62 reaches a set operating temperature, a user may begin operating the appliance 18. In a further embodiment, the indicator light 36 (or another light) may indicate when the heating element 62 has reached the set operating temperature by changing state (e.g., blinking, color change, etc.).

In the method of use illustrated in FIG. 5, the user grasps the handle portion 28 of the housing 24 and positions the hair care appliance 18 such that a section of hair is gathered within the work area partially defined by the spacer 22 and extending around and beyond the spacer 22 (indicated by a dashed line perimeter). The user depresses the actuator 38 to activate the pump 60. Vapor is discharged through the spacer apertures 58 into the gathered hair. The actuator 38 is depressed until the gathered hair is sufficiently saturated with vapor and is then released. The heated moisture diffusing through the work area comes in contact with the user's hair and reactivates the curls and/or increases moisture and volume. In the illustrated embodiment of FIG. 5, the spacer elements 56 also provide support to the gathered section of hair while it is treated with vapor in order to facilitate the reactivation and setting of the curls. The hair care appliance 18 is then repositioned to gather other sections of hair within the work area, and the actuator 38 is again triggered causing the release of vapor. This is repeated as necessary to add moisture to hair and reactivate curls and waves. As illustrated, the spacer elements 56 are generally pointed upward (opposite the direction of gravity) when the hair being treated is longer.

With reference to FIG. 6, the hair care appliance 18 can be used in conjunction with styling accessories (e.g., roller, hook, pin, clip, etc.), which hold each portion of hair in a desired position or shape while it is treated. In some embodiments, a styling accessory may facilitate the set of a curl, crimp, or wave because it maintains the position/shape of each hair portion after the application of vapor (i.e., while the treated portion cools). While FIG. 6 illustrates one method of use of the hair care appliance 18 with styling accessories, many more are contemplated. Consequently, the term "set" in the following description and claims is intended to indicate hair that is positioned, shaped or held by any styling accessory, and the term "curl" is intended to encompass wave or crimp as well.

As illustrated in FIG. 6, a section of hair is wound around a roller 74. In a further embodiment, sections of hair may be wound and pinned or clipped in place, which may have a similar effect. Then the user grasps the handle portion 28 of the housing 24 and positions the hair care appliance 18 such that a section of set hair is within the work area partially defined by the spacer 22 and extending around and beyond the spacer 22 (indicated by a dashed line perimeter). In some cases, the spacer elements 56 may be in direct contact with the set hair. As illustrated, the spacer elements 56 are generally pointed toward the user's head when the hair being treated is set close to the head as shown. (The hair care appliance 18 may be positioned similarly to enhance or reactivate curls or waves without styling accessories in shorter hair.) In the illustrated embodiment of FIG. 6, the spacer elements 56 prevent the user from positioning the hair care appliance 18 too close to the scalp and consequently prevent injury to the user by the hot vapor expelled from the appliance 18.

When the hair care appliance 18 is positioned appropriately as discussed above, the user depresses the actuator 38 to activate the pump 60 and vapor is discharged through the spacer apertures 58 into the set hair. The heated moisture diffusing through the work area comes in contact with the user's hair and curls the hair and/or increases moisture and volume. The hair care appliance 18 is then repositioned to gather other sections of set hair within the work area, and the actuator 38 is again triggered causing the release of vapor. This is repeated as necessary to add moisture to hair and create or enhance curl in relatively straight hair or to relax curl in relatively curly or wavy hair, depending on how the hair is set (i.e., the size of the roller 74). For example, if the hair is set with rollers 74 having a larger diameter than the user's natural hair curl, the result after use of the hair care appliance 18 will be a more relaxed (i.e., larger diameter, looser) curl or wave. Alternatively, if the hair is set with rollers 74 having a smaller diameter than the user's natural hair curl, the result will be a tighter curl. In a further embodiment the hair care appliance 18 may be used as an animal grooming tool.

FIGS. 8-11 illustrate a hair care appliance 118 according to another embodiment of the invention. The hair care appliance 118 shown in FIGS. 8-11 is similar to the hair care appliance 18 illustrated in FIGS. 1-7 and described above. Accordingly, with the exception of mutually inconsistent features and elements between the embodiment of FIGS. 8-11 and the embodiment of FIGS. 1-7, reference is hereby made to the description above accompanying the embodiment of FIGS. 1-7 for a more complete description of the features and elements (and alternatives and/or additions to the features and elements) of the embodiment of FIGS. 8-11. Features and elements in the embodiment of FIGS. 8-11 corresponding to features and elements in the embodiments of FIGS. 1-7 are numbered in the 100 series.

Figure 8:
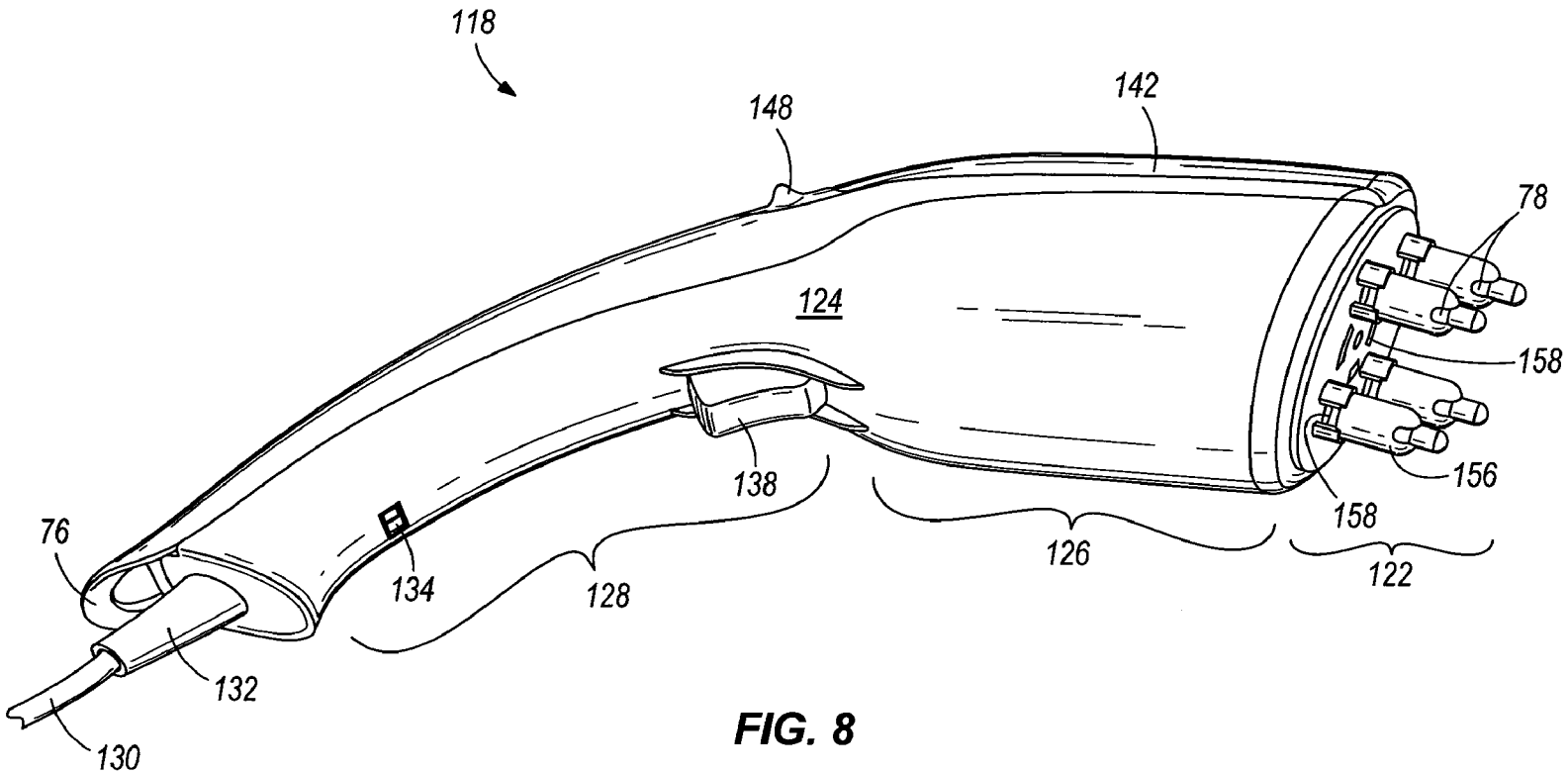
FIG. 8 is a bottom perspective view of a hair care appliance according to another embodiment of the invention.
Figure 9:
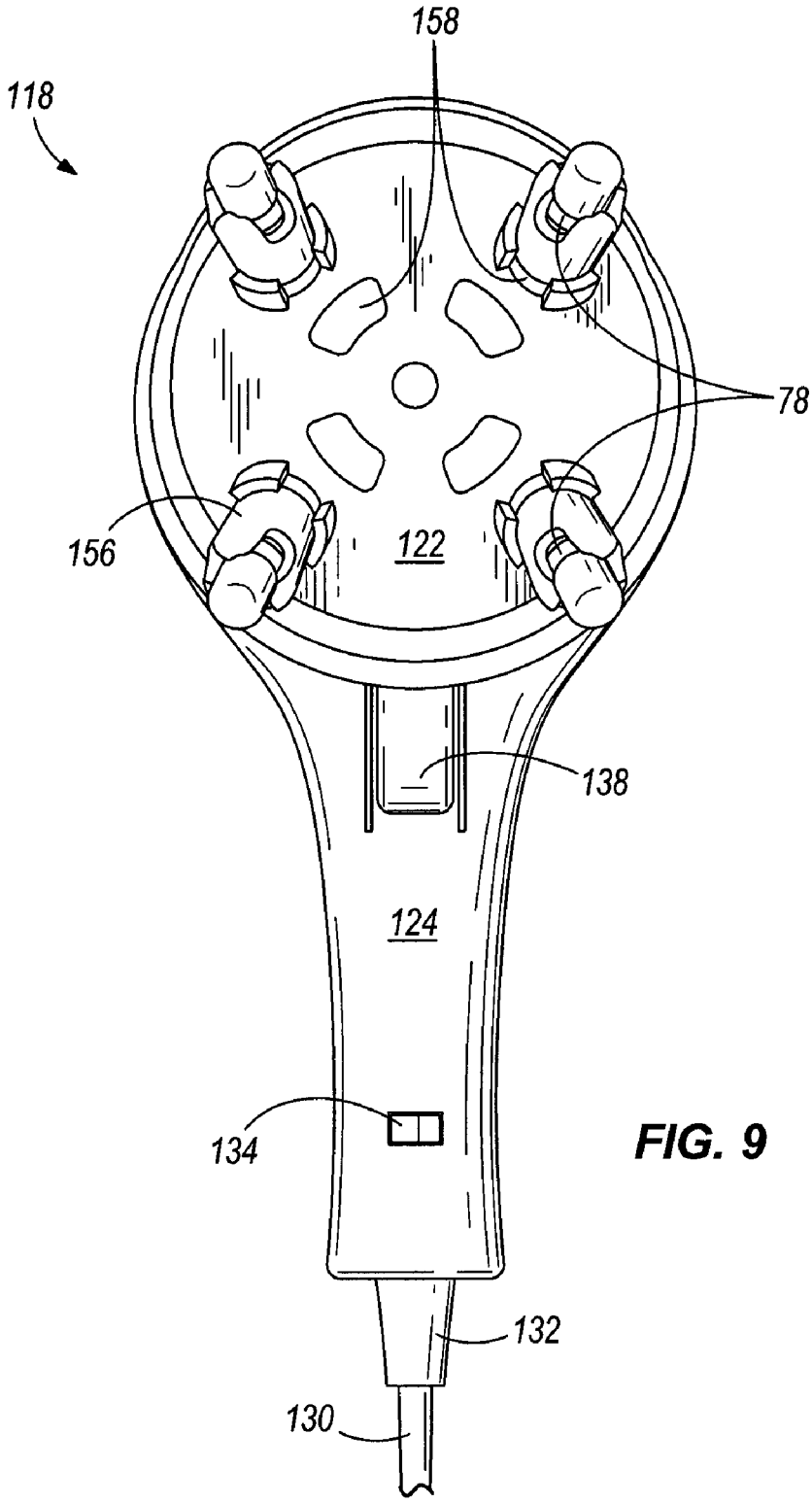
FIG. 9 is a front view of the hair care appliance shown in FIG. 8.
Figure 10:
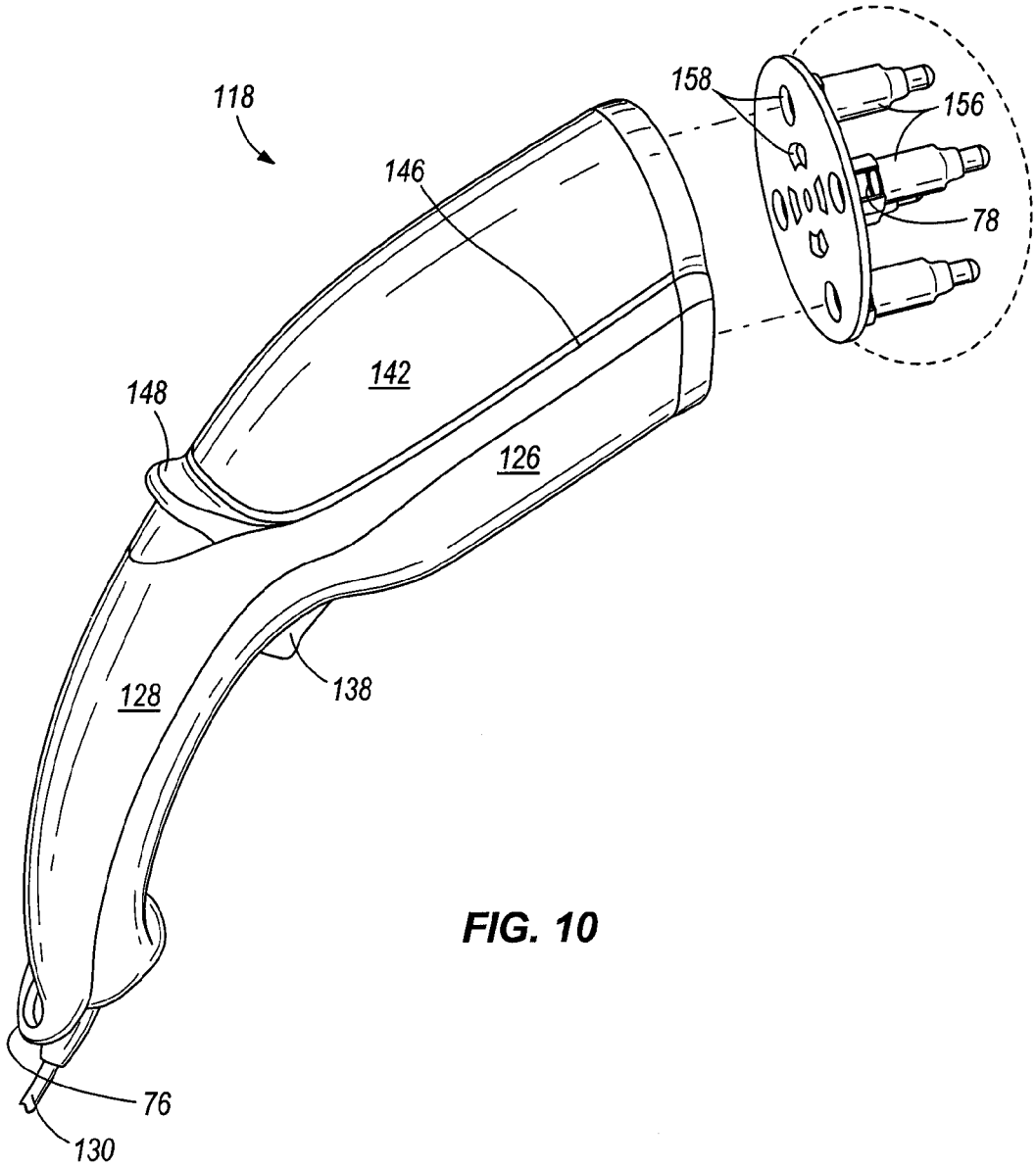
FIG. 10 is a partially exploded view of the hair care appliance shown in FIG. 8.

Referring to FIG. 8-10, the housing 124 of hair care appliance 118 includes a hanging loop 76 extending from an end of the handle portion 128 adjacent the power cord 130. The power switch 134 is located on the bottom side of the housing 124 between the actuator 138 and the distal end of the handle portion 128. The spacer 122 includes four spacer elements 156 positioned above spacer apertures 158. Each spacer element 156 is partially hollow and surrounds a spacer aperture 158 to aid in dispersing vapor from the hair care appliance 118 onto a user's hair. As shown in the illustrated embodiment, the spacer elements 156 include apertures 78; thereby, some vapor dispersed from the vapor-generating system 20 travels through the spacer elements 156 to a user's hair. In a further embodiment, fewer or more spacer elements 156 may be formed in the spacer 122 or the spacer elements 156 may not be hollow or include apertures 78 to disperse vapor.

Figure 11:
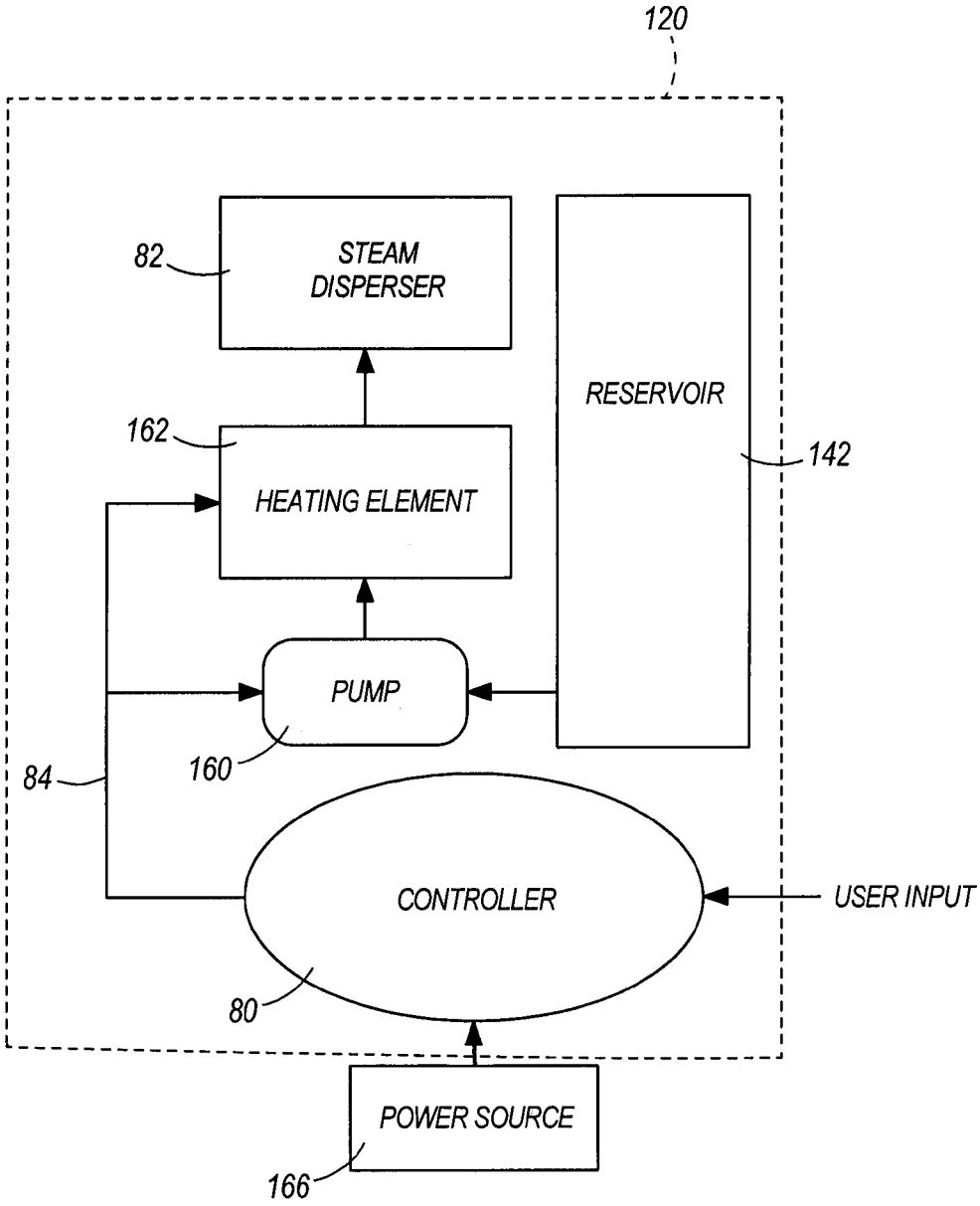
FIG. 11 is a schematic of another embodiment of the vapor-generating system of the hair care appliance.

FIG. 11 illustrates one embodiment of the vapor-generating system 120 located within the inner cavity 140 of the hair care appliance 118. In the illustrated embodiment, the vapor-generating system 120 includes a controller 80, a reservoir 142, a pump 160, a heating element 162, and a vapor discharge system 82.

The actuator 138 located on the housing 124 provides a user interface with the controller 80 located within the housing 124. In a further embodiment having a power switch 134, actuating the power switch 134 to an "on" position allows electricity to flow to the controller 80 and the heating element 162. The pump 160 pumps or transfers liquid from the reservoir 142 to the heating element 162 in response to a signal 84 from the controller 80. In a further embodiment, a user input via a multi-setting switch may increase or decrease the rate at which liquid is pumped, thereby creating more or less vapor. The vapor travels via the vapor discharge system 82 out of the housing 124 through the spacer apertures 158, 78. In its simplest form, the vapor discharge system 82 is a conduit from the heating element 162 (located inside the housing 124) to the work area. The vapor discharge system 82 of the illustrated embodiment includes the spacer apertures 158, hollow spacer elements 156, and apertures 78. In a further embodiment, the vapor discharge system 82 may include a fan or similar device to help expel the vapor into the work area.

Various features and advantages of the invention are set forth in the following claims.

What is claimed is:

1. A hair care appliance for application of vapor to dry hair to provide humidity to the hair, the hair care appliance comprising:

a housing including a head portion and a handle portion, the housing defining an inner cavity;

a vapor-generating system including a reservoir for receiving liquid and positioned at least partially within the cavity and defining a flow path from the reservoir, the vapor-generating system including, positioned within the cavity, at least one of a heating element for generating vapor from the liquid and a pump for moving the liquid along the flow path, the head portion including an aperture in communication with the vapor-generating system; and a spacer positioned proximate the aperture of the head portion, the spacer partially defining a work area, wherein the vapor-generating system discharges vapor to the work area for application to hair positioned thereby.

2. The hair care appliance according to claim 1 wherein the spacer includes a projection extending from the head portion of the housing.

3. The hair care appliance according to claim 1 wherein the spacer is removably coupled to the housing.

4. The hair care appliance according to claim 1, and further comprising a manifold positioned along the flow path to cool the vapor before it is discharged into the work area.

5. The hair care appliance according to claim 1, and further comprising an indicator light.

6. The hair care appliance according to claim 1, and further comprising an actuator for selectively discharging vapor from the vapor-generating system and into the work area.

7. The hair care appliance according to claim 1 wherein the reservoir is removable from the housing.

8. A method of providing humidity to dry hair, the method comprising:

providing a hand-held vapor-generating device having a head portion at least partially defining a work area, the vapor-generating device including a vapor-generating system including a reservoir for receiving liquid and positioned at least partially within the cavity and defining a flow path from the reservoir, the vapor-generating system including, positioned within the cavity, at least one of a heating element and a pump;

positioning the device relative to a user's head such that hair is gathered within the work area;

generating vapor with the vapor-generating system, generating including at least one of generating vapor from the liquid with the heating element and pumping liquid with the pump along the flow path; and discharging the vapor from the device into the work area such that vapor contacts the hair gathered therein.

9. The method of claim 8, and further comprising adjusting a setting level on the device to vary a flow of vapor from the device.

10. The method of claim 8 wherein discharging vapor from the device is accomplished by depressing an actuator on the device.

11. The method of claim 8, and further comprising setting a portion of the user's hair with a styling accessory prior to discharging the vapor.

12. A hair care appliance for application of vapor to dry hair to provide humidity to the hair, the hair care appliance comprising:

a housing defining an inner cavity and including an aperture;

a spacer coupled to the housing and at least partially defining a work area in which a user's hair is gathered; and a vapor-generating system including a reservoir for receiving liquid and at least partially disposed within the cavity and defining a flow path from the reservoir, the vapor-generating system including, positioned within the cavity, at least one of a heating element for generating vapor from the liquid and a pump for moving the liquid along the flow path, wherein the aperture provides a fluid pathway for discharging vapor from the vapor-generating system into the work area.

13. The hair care appliance according to claim 12 wherein the vapor-generating system includes, positioned within the cavity, the pump.

14. The hair care appliance according to claim 13 wherein the pump is activated by the user via an actuator on the housing.

15. The hair care appliance according to claim 13 wherein the pump is a centrifugal run-dry pump.

16. The hair care appliance according to claim 12 wherein the reservoir is formed by fusing two dish-shaped polymer pieces.

17. The hair care appliance according to claim 12, and further comprising a timer to provide an automatic shutoff feature.

18. The hair care appliance according to claim 12 wherein two points on the spacer and a point on the housing define a stable resting position for the appliance.

19. The hair care appliance according to claim 12 wherein the vapor-generating system further includes a controller.

20. The hair care appliance according to claim 19 wherein a multi-setting switch provides input from the user to the controller.

21. The hair care appliance of claim 1 wherein the vapor-generating system includes, positioned within the cavity, the heating element.

22. The hair care appliance of claim 1 wherein the vapor-generating system includes, positioned within the cavity, the pump.

23. The hair care appliance of claim 1 wherein the vapor-generating system includes, positioned within the cavity, the heating element and the pump.

24. The hair care appliance of claim 1 wherein the spacer includes a cap and a plurality of spacer elements projecting outwardly from the cap, the spacer elements partially defining therebetween the work area.

25. The method of providing humidity to dry hair of claim 8, wherein the vapor-generating system includes, positioned within the cavity, the heating element, and wherein generating includes generating vapor from the liquid with the heating element.

26. The method of providing humidity to dry hair of claim 8, wherein the vapor-generating system includes, positioned within the cavity, the pump, and wherein generating includes pumping liquid with the pump along the flow path.

27. The method of providing humidity to dry hair of claim 8, wherein the vapor-generating system includes, positioned within the cavity, the heating element and the pump, and wherein generating includes generating vapor from the liquid with the heating element and pumping liquid with the pump along the flow path.

28. The method of providing humidity to dry hair of claim 8, wherein the head portion includes a plurality of spacer elements projecting outwardly from the head, the spacer elements at least partially defining therebetween the work area.

29. The hair care appliance of claim 12 wherein the vapor-generating system includes, positioned within the cavity, the heating element.

30. The hair care appliance of claim 12 wherein the vapor-generating system includes, positioned within the cavity, the heating element and the pump.

31. The hair care appliance of claim 12 wherein the spacer includes a cap and a plurality of spacer elements projecting outwardly from the cap, the spacer elements at least partially defining therebetween the work area.

32. A hair care appliance for application of vapor to dry hair to provide humidity to the hair, the hair care appliance comprising:

a housing including a head portion and a handle portion, the housing defining an inner cavity;

a vapor-generating system positioned at least partially within the cavity, the vapor-generating system including a reservoir for receiving liquid and defining a flow path from the reservoir, the vapor-generating system including a pump for moving the liquid along the flow path, the head portion including an aperture in communication with the vapor-generating system; and a spacer positioned proximate the aperture of the head portion, the spacer partially defining a work area, wherein the vapor-generating system discharges vapor to the work area for application to hair positioned thereby.

* * * * *

UNITED STATES PATENT AND TRADEMARK OFFICE

CERTIFICATE OF CORRECTION

PATENT NO. : 8,136,263 B2
APPLICATION NO. : 12/195819
DATED : March 20, 2012
INVENTOR(S) : Heidi Schmid It is certified that error appears in the above-identified patent and that said Letters Patent is hereby corrected as shown below:

On the Title page of the patent, delete "(73) Assignee: Heidi Schmid, Whitefish Bay, WI (US)"

Signed and Sealed this
Fourteenth Day of August, 2012

David J. Kappos

David J. Kappos
*Director of the United States Patent and Trademark Office*